US005993317A

United States Patent [19]

Majima

[11] Patent Number: 5,993,317

[45] Date of Patent: Nov. 30, 1999

[54] APPARATUS FOR HOLDING SLIP VERIFICATION UNIT IN A GAME MACHINE AND GAME MACHINE INCORPORATING THE SAME

[75] Inventor: Shiro Majima, Artarmon, Australia

[73] Assignee: Konami Co., Ltd., Hyogo-ken, Japan

[21] Appl. No.: 09/109,356

[22] Filed: Jul. 2, 1998

[30] Foreign Application Priority Data

Aug. 6, 1997 [JP] Japan ..... 9-211658

[51] Int. Cl.[6] ..... G07F 7/04

[52] U.S. Cl. ..... 463/29; 273/138.2; 194/206; 194/350

[58] Field of Search ..... 273/143 R, 138.2; 463/29, 20; 194/206, 350

[56] References Cited

U.S. PATENT DOCUMENTS

| | | | |
|---|---|---|---|
| 5,515,959 | 5/1996 | Stephenson, III et al. | 194/206 |
| 5,544,728 | 8/1996 | Dabrowski | 194/206 |
| 5,676,231 | 10/1997 | Legras et al. | 194/206 |
| 5,700,195 | 12/1997 | Halic | 463/29 |
| 5,740,897 | 4/1998 | Gauselmann | 194/206 |

FOREIGN PATENT DOCUMENTS

| | | |
|---|---|---|
| 680160B | 7/1997 | Australia . |
| 762344 | 3/1997 | European Pat. Off. . |
| 2305763 | 4/1997 | United Kingdom . |

*Primary Examiner*—Benjamin H. Layno
*Attorney, Agent, or Firm*—Jordan and Hamburg LLP

[57] ABSTRACT

A holding apparatus incorporated in the housing of a game machine holds a slip verification unit which includes a slip checkup device and a stacker disposed under the slip checkup device and combined therewith through a pair of mating connectors. The holding apparatus includes a stacker-receiving unit capable of receiving the stacker therein and having a front side closed by a door which when opened permits access to the interior of the stacker-receiving unit, a checkup-device carrier unit capable of carrying the checkup device and movable relative to the stacker-receiving unit so as to being the connectors into and out of engagement with each other, and an interconnecting mechanism which operatively interconnects the door of the stacker-receiving unit and the checkup-device carrier unit such that the connectors are disengaged from each other when the door of the stacker-receiving unit is opened.

18 Claims, 14 Drawing Sheets

APPARATUS FOR HOLDING SLIP VERIFICATION UNIT IN A GAME MACHINE AND GAME MACHINE INCORPORATING THE SAME

BACKGROUND OF THE INVENTION

1. Field of the Invention

The present invention relates to an apparatus for holding a slip verification unit at a predetermined position in a game machine such as a slot machine. The present invention is also concerned with a game machine incorporating such a holding apparatus.

2. Description of the Related Art

In general, a game machine such as a slot game machine has a slip verification unit having a slip checkup device and a slip stacker disposed under the checkup device. The checkup device checks a slip put by a game player into the game machine to judge whether the slip is appropriate acceptable or to be rejected as being, for example, a fake. Only the slips judged as being appropriate are stacked in the stacker under the checkup device. Such a slip verification unit is required to simultaneously satisfy two requirements: namely, highly strict restriction to removal of the stacker which stored the slips which are often cash bills, and ease of removal of the checkup device for inspection and maintenance. In order to meet these requirements, a typical conventional game machine of the kind described has a holding apparatus provided in the machine housing for holding the slip verification unit. The holding apparatus has a vessel-like stacker-receiving unit having a front lockable access door, and a checkup device holding unit disposed above the stacker-receiving unit and capable of detachably holding the checkup device. Removal of the stacker from the holding apparatus requires pulling the stacker after the front door of the stacker-receiving unit is unlocked and opened. The upper surface of the stacker and the lower surface of the checkup device are connected through a pair of mating connectors that are used for the purpose signal transmission and so forth between the stacker and the checkup device. These connectors when mating each other prevent the stack from being pulled out of the stacker-receiving unit. Therefore, a typical conventional apparatus has a mechanism operatively associated with the front door such that it moves the stacker-receiving unit downward in response to opening of the front door, so as to disengage the connectors, thereby enabling the stacker to be pulled out of the stacker-receiving unit.

The stacker is large and, hence, heavy as compared with the checkup device, in order that it accommodates a good deal of slips. Large actuating power and a rigid linking mechanism are required to move such a heavy stacker up and down in response to the action of the door. Consequently, the holding apparatus is rendered large and heavy, resulting in a raise of the costs of production and other deficiencies. For instance, if the holding apparatus and the associated linking mechanism are formed by metal sheet work, much labor and costs are required due to increase in the sheet thickness and necessity of reinforcement members.

SUMMARY OF THE INVENTION

Accordingly, it is an object of the present invention to provide a slip verification unit holding apparatus capable of engaging and disengaging connectors between the stacker and the checkup device without fail in response to actions of the door of the stacker-receiving unit, while reducing the required level of actuating power and rigidity of the linking mechanism.

To this end, according to one aspect of the present invention, there is provided a holding apparatus for holding a slip verification unit which is incorporated in the housing of a game machine and which includes a checkup device for checking slips and a stacker disposed under the checkup device and capable of accommodating a stack of the slips accepted by the checkup device, the checkup device and the stacker being connected through a pair of mating connectors, the holding apparatus comprising: a stacker-receiving unit for receiving the stacker therein, having a front door closing the front side and movable to an open position to open the front side thereof; a checkup-device carrier unit capable of carrying the checkup device and movable relative to the stacker-receiving unit in such directions as to bring the mating connectors into and out of engagement with each other; and an interconnecting mechanism for operatively interconnecting the door and the checkup-device carrier unit such that the checkup-device carrier unit moves to disengage the mating connectors when the door is opened.

According to this embodiment, opening of the door of the stacker-receiving unit causes the checkup device to move so as to disengage the connectors between the stacker and the checkup device. Consequently, the stacker can be pulled forwardly out of the stacker-receiving unit, without obstruction which otherwise may be caused by the engagement between the connectors. Since the disengagement between the connectors can be achieved by moving the checkup device which is comparatively light weight, the required levels of rigidity of the interconnecting mechanism and the actuating power can be significantly reduced as compared with the conventional arrangement in which the large and heavy stacker is moved up and down to achieve disengagement between the connectors.

The checkup-device carrier unit may have a first holding part for holding the checkup device and a second holding part connected to the first holding part for relative movement therebetween in a predetermined direction, the checkup device being detachable from the checkup-device carrier unit by a movement of the first holding part relative to the second holding part while the second holding part is held at a predetermined position relative to the stacker-receiving unit.

According to this arrangement, for the purpose of removing the stacker, both the first holding part and the second holding part are moved relative to the stacker-receiving unit so as to disengage the connectors, without requiring demounting of the checkup device from the checkup-device carrier unit. On the other hand, when it is desired to demount the checkup device from the holding apparatus, the first holding part can be moved relative to the second holding part to a position suitable for the demounting of the checkup device.

The checkup device may have a movable part operable to open a passage of the slips, and wherein the checkup-device carrier unit has a space which accommodates the movement of the movable part of the checkup device while the checkup device is carried by the checkup-device carrier unit.

According to this arrangement, the movable part alone of the checkup device is moved to open the slip passage, while the remainder main part of the checkup device remains on the holding apparatus. It is therefore possible to deal with problems such as jamming of a slip, without requiring demounting of the checkup device. The above-mentioned space for accommodating the movement of the movable part of the checkup device may be used as a space that is necessary when the whole checkup device is demounted from the holding apparatus.

The arrangement may be such that the checkup-device carrier unit and the stacker-receiving unit are rotatably connected to each other through a horizontal shaft disposed on the stacker-receiving unit at a position that is on the same side of the connectors as the front end of the stacker-receiving unit. In this case, the door is swingably carried by a horizontal door shaft provided on a lower portion of the stacker-receiving unit for movement between open and close positions about an axis provided by the door shaft, and the interconnecting mechanism includes a link mechanism which interconnects the door and a pivot point provided on the checkup-device carrier unit at a position which is on the same side of the connecting shaft as the front end of the stacker-receiving unit.

According to this arrangement, swing of the door about the door shaft to open position causes the checkup device to be pulled downward through the link mechanism. As a result, the checkup device is rotated about the connecting shaft so as to raise its rear end, thereby disengaging the mating connectors.

Preferably, the link mechanism includes link elements and means for limiting the movement of the link elements such that a force for bringing the connectors into engagement is generated in response to the closing motion of the door immediately before reaching the full shut position.

With this arrangement, the force acting to close the door is converted into a force which brings the connectors into engagement with each other, immediately before the door is fully shut, so that the connectors firmly engage with each other without fail.

Preferably, the checkup-device carrier unit includes: a first holding frame for receiving the checkup device; a second holding frame surrounding the first holding frame and rotatably connected to the first holding frame through a horizontal shaft, the second holding frame having the pivot point thereon; and change-over means for effecting change-over between a state which permits relative rotation between the first and second holding frames and a state which prohibits such a relative rotation.

With this arrangement, when the first and second holding frames are locked against rotation relative to each other, the opening and closing motion of the door of the stacker-receiving unit causes both frames to rotate as a unit about the connecting shaft, so as to disengage the mating connectors. Conversely, when the first and second holding frames are allowed to rotate relative to each other, the first holding frame alone can be rotated about the connecting shaft to a position suitable for demounting the checkup device, while the second holding frame remains held at a constant posture with respect to the stacker-receiving unit. The shaft about which the first holding frame alone rotate may be the same as the horizontal connecting shaft which commonly supports the checkup-device carrier unit and the stacker-receiving unit, or may be a separate shaft.

The change-over means includes at least a pair of mutually cooperating engaging portions, such as a combination of a movable member associated with the first holding frame and a retaining groove provided in the second holding frame and capable of receiving part of the movable member, or a combination of a magnet provided on one of the first and second holding frames and a magnetic member provided on the other of the first and second holding frames.

When both types of combination are used simultaneously, the first holding frame and the second holding frame are more securely held on each other, when both holding frames are locked against rotation relative to each other.

Preferably, the movable member is engageable with the checkup device from the upper side of the checkup device when the aforementioned part of the movable member is received in the retaining groove. The movable member upon engagement with the checkup device serves to prevent the checkup device from floating above the first holding frame, when the checkup device is moved to bring the connectors into engagement with each other.

The present invention also provides a game machine incorporating the holding apparatus having features set forth above.

Thus, in accordance with another aspect of the present invention, there is provided a game machine, comprising: a main body having a housing; a slip verification unit including a checkup device for checking slips and a stacker disposed under the checkup device and connected thereto through a pair of mating connectors, the stacker receiving slips which have been accepted through the checkup device; a holding apparatus for holding the slip verification unit; and a structure for fixing the holding apparatus to the housing; wherein the holding apparatus comprises: a stacker-receiving unit for receiving the stacker therein, having a front door closing the front side and movable to an open position to open the front side thereof; a checkup-device carrier unit capable of carrying the checkup device and movable relative to the stacker-receiving unit in such directions as to bring the mating connectors into and out of engagement with each other; and an interconnecting mechanism for operatively interconnecting the door and the checkup-device carrier unit such that the checkup-device carrier unit moves to disengage the mating connectors when the door is opened.

The structure for fixing the holding apparatus to the housing is preferably adjustable to vary the position of the holding apparatus with respect to the housing at least in one of the vertical direction, left and right direction and back and forth direction. The adjustable structure permits a slip receptacle of the slip verification unit to be exactly aligned with a slip-receiving slit formed in a part of the housing.

It is also preferred that the structure for fixing the holding apparatus to the housing is accessible for the removal of the holding apparatus from the housing only from the interior of the stacker-receiving unit. This arrangement makes it quite difficult to carry out the stacker together with the holding apparatus from the housing of the game machine, thus offering an antitheft effect.

The above and other objects, features and advantages of the present invention will become clear from the following description of the preferred embodiments when the same is read in conjunction with the accompanying drawings.

and

Figure 11:
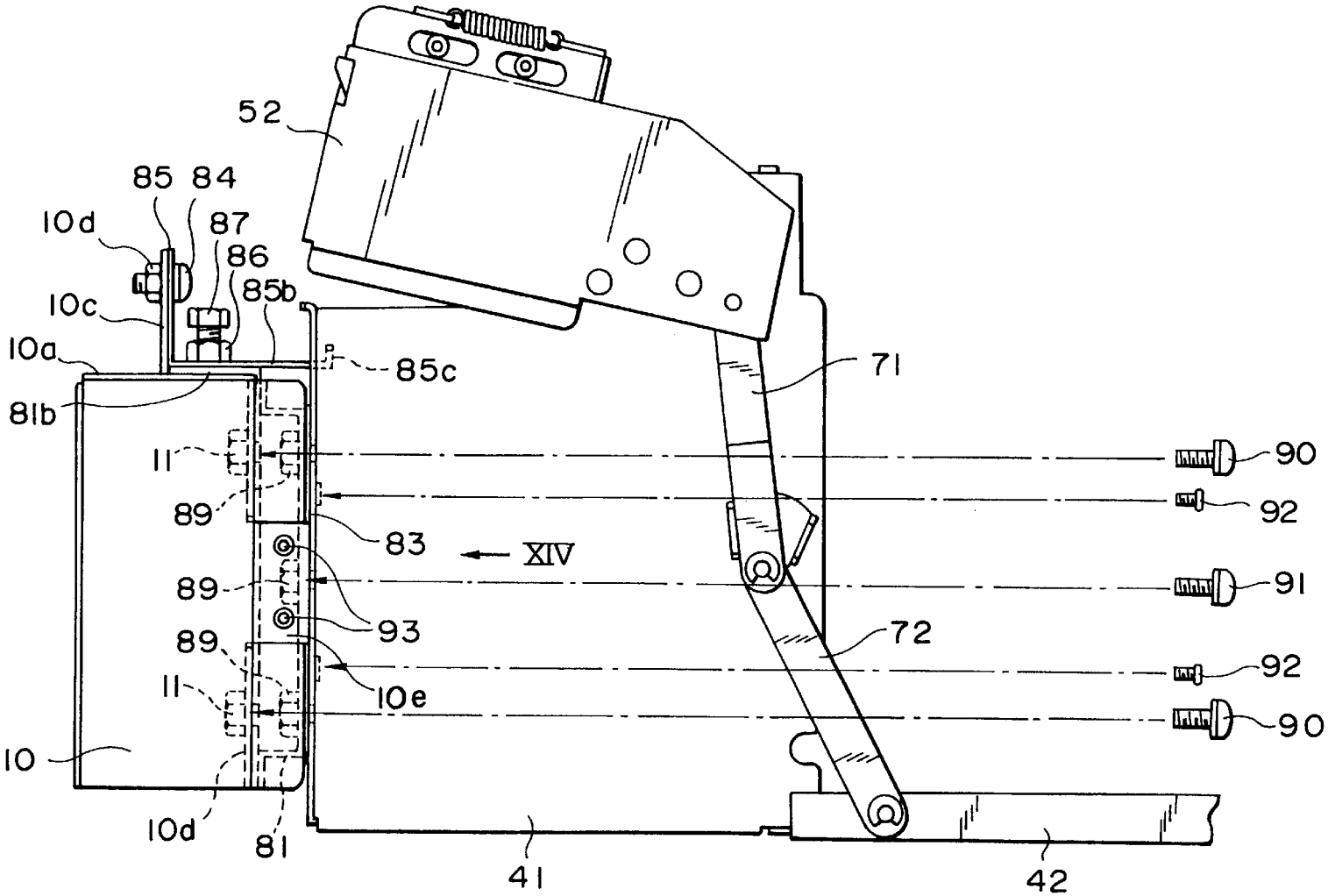
FIG. 11 is an illustration of a mechanism which links the holding apparatus to the housing of the slot machine.
Figure 12:
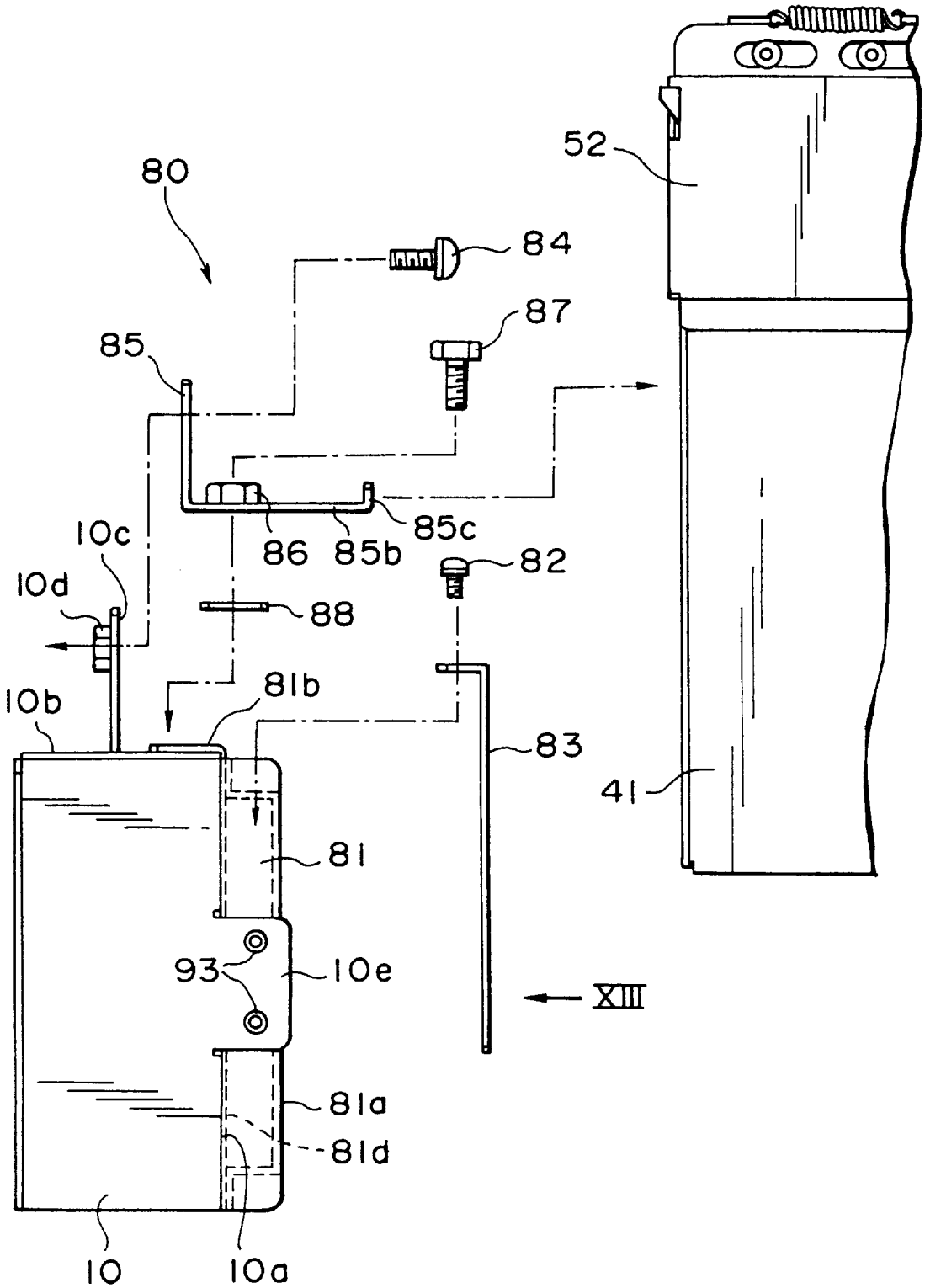
FIG. 12 is an exploded view of the mechanism shown in FIG. 11.
Figure 14:
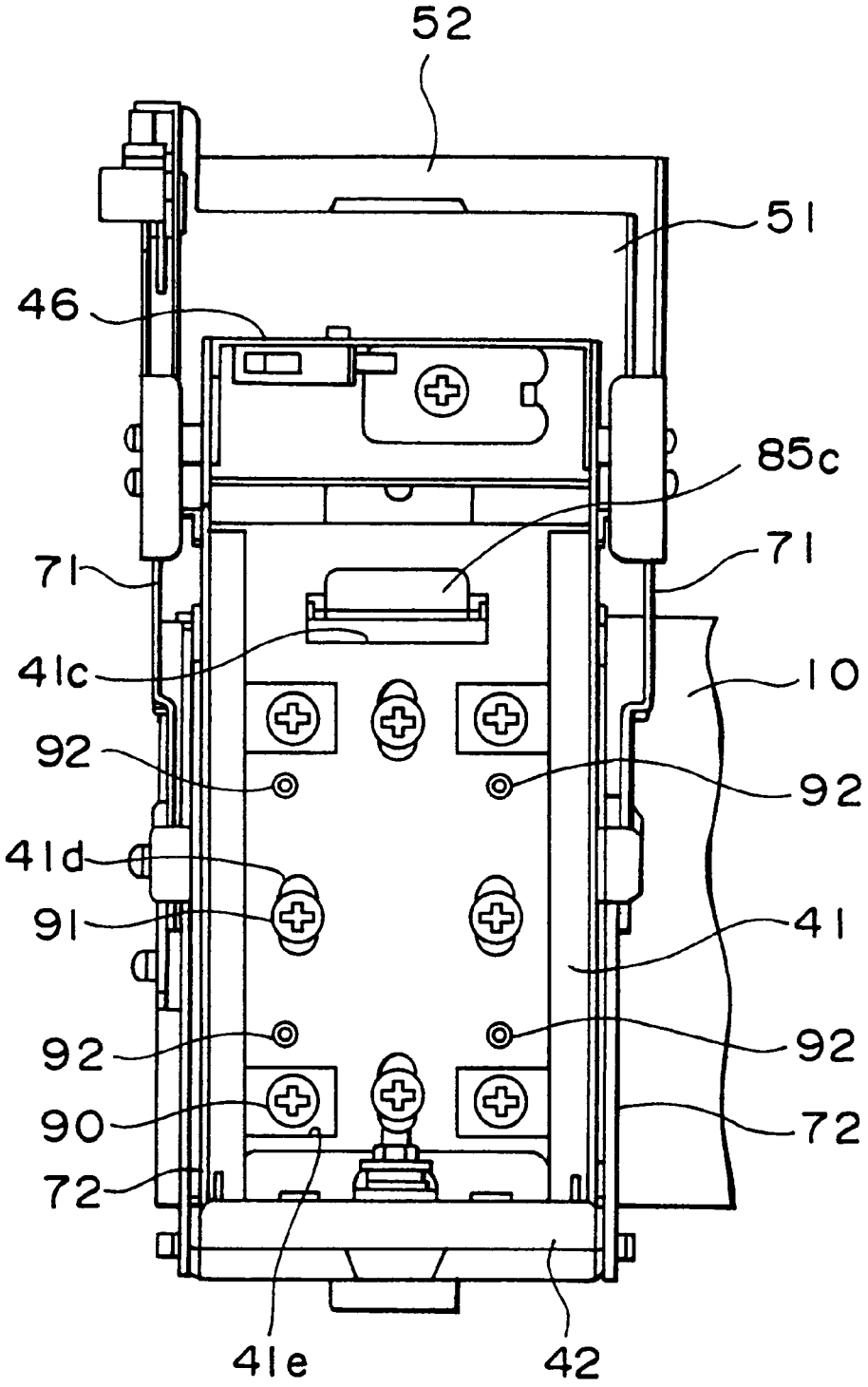

FIG. 14 is an illustration of the mechanism of FIG. 11, as viewed in the direction of the arrow XIV of FIG. 11.

DESCRIPTION OF THE PREFERRED EMBODIMENTS

Figure 1:
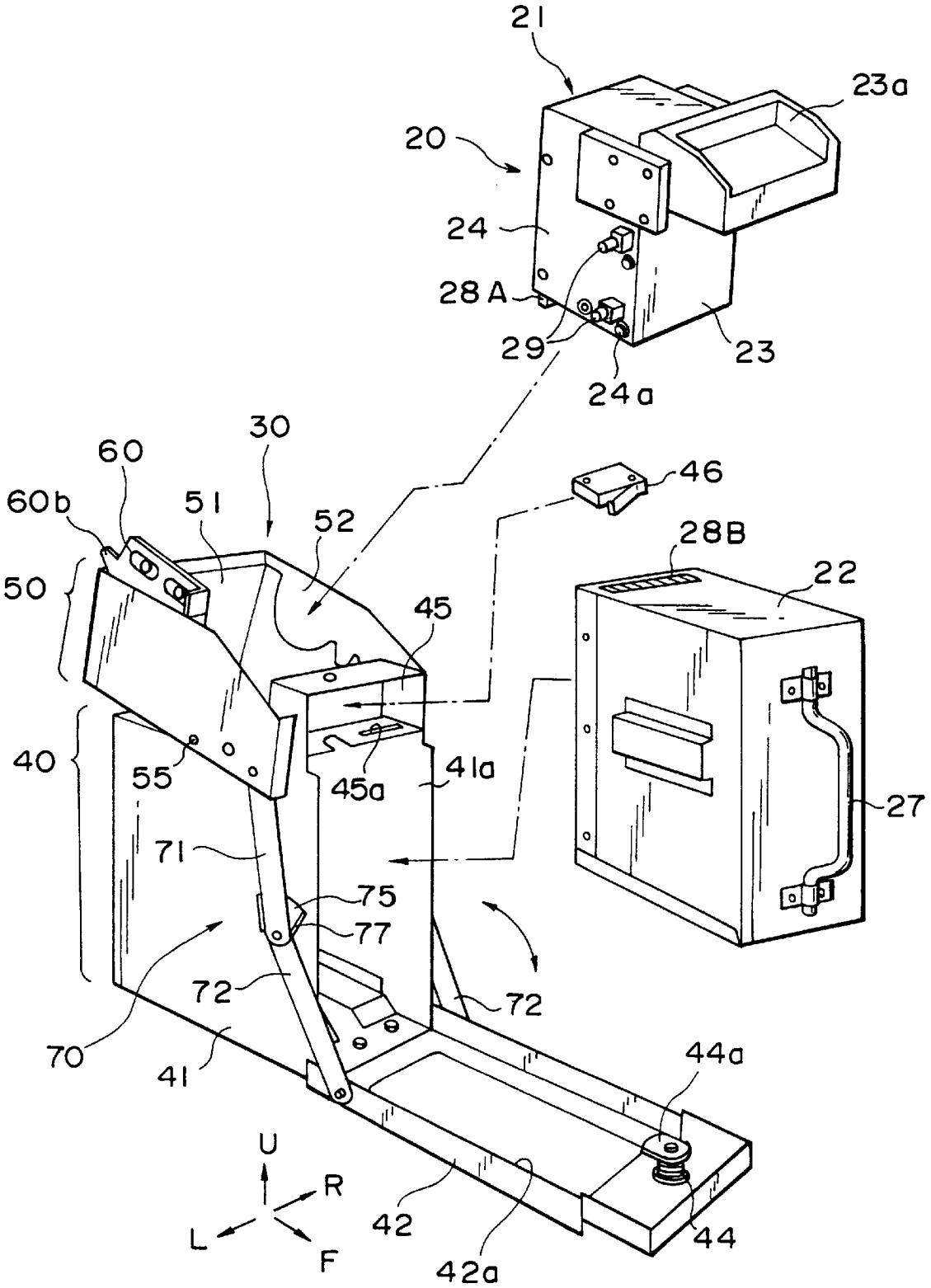
FIG. 1 is a perspective view of an embodiment of the holding apparatus in accordance with the present invention.
Figure 2B:
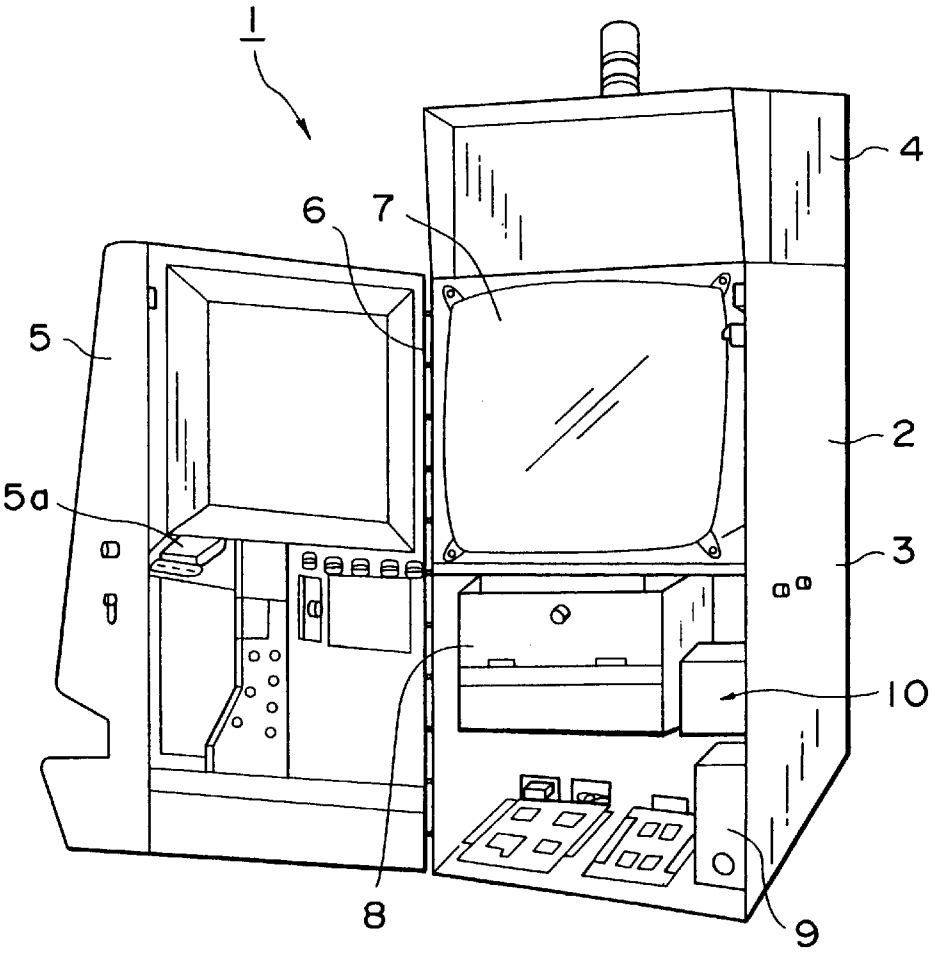
FIG. 2B is a perspective view of the slot machine, with the front door opened to show the internal structure.
Figure 2A:
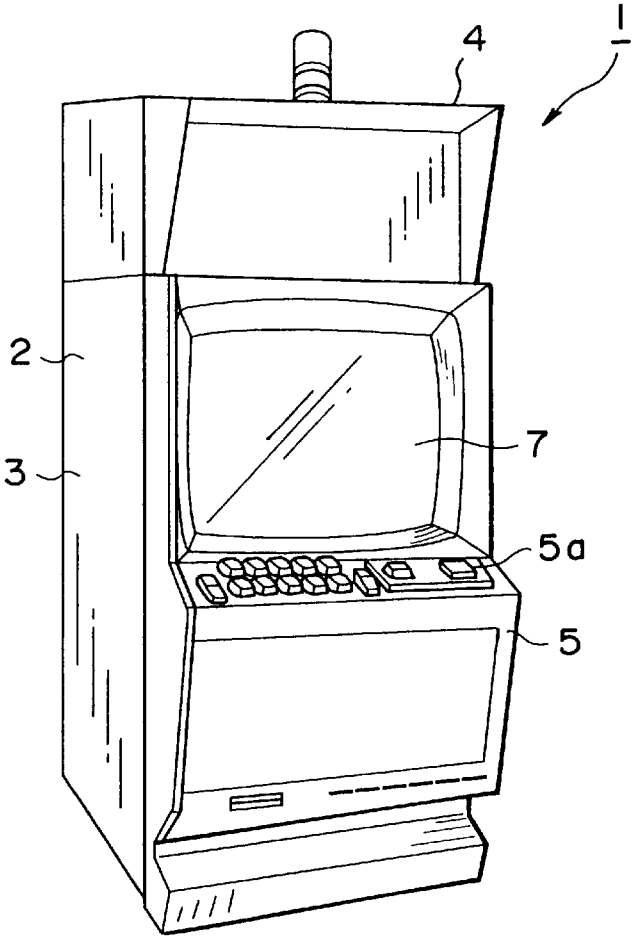
FIG. 2A is a perspective view of a slot machine incorporating the holding apparatus shown in FIG. 1, with a front door being closed.

Referring to FIGS. 2A and 2B, a slot machine 1 incorporating the holding device of the present invention has various parts and components mounted in and on a housing 2 standing upright. The housing 2 has a main part 3 and a top box 4 secured to the top of the main part 3. A door 5 is secured to the main part 3 through a hinge 6 provided on the left side thereof, so as to be swingable between an open position and a close position. The main part 3 accommodates a monitor 7 under which are disposed an electric part box 8, an A.C. power supply unit 9 and a mounting base 10. A slip verification unit 20 (see FIG. 1) is detachably mounted on the mounting base 10, through a holding apparatus 30 (see FIG. 1). The slip verification unit 20 verifies a sheet or slip inserted by a game player into the game machine through a slit 5*a* formed in the door 5*a*. Depending on the countries in which the game machine is used, cash bills may be used as the slip to be verified. The electric part box 8 accommodates electric parts including a control circuit for controlling the slot machine 1.

FIG. 1 schematically shows the slip verification unit 20 and the holding apparatus 30 that holds the slip verification unit 20. An arrow F indicates forward direction as viewed from the housing 2, i.e., the direction in which the door 5 is disposed when viewed from the center of the space inside the housing 2. Similarly, arrows U, R and L respectively represent upward, rightward and leftward directions. In the following description, the terms in regard to the directions and positions, e.g., front and back, left and right and up and down, are used in accordance with the definitions given by these arrows F, U, R and L, unless otherwise specified.

Figure 3:
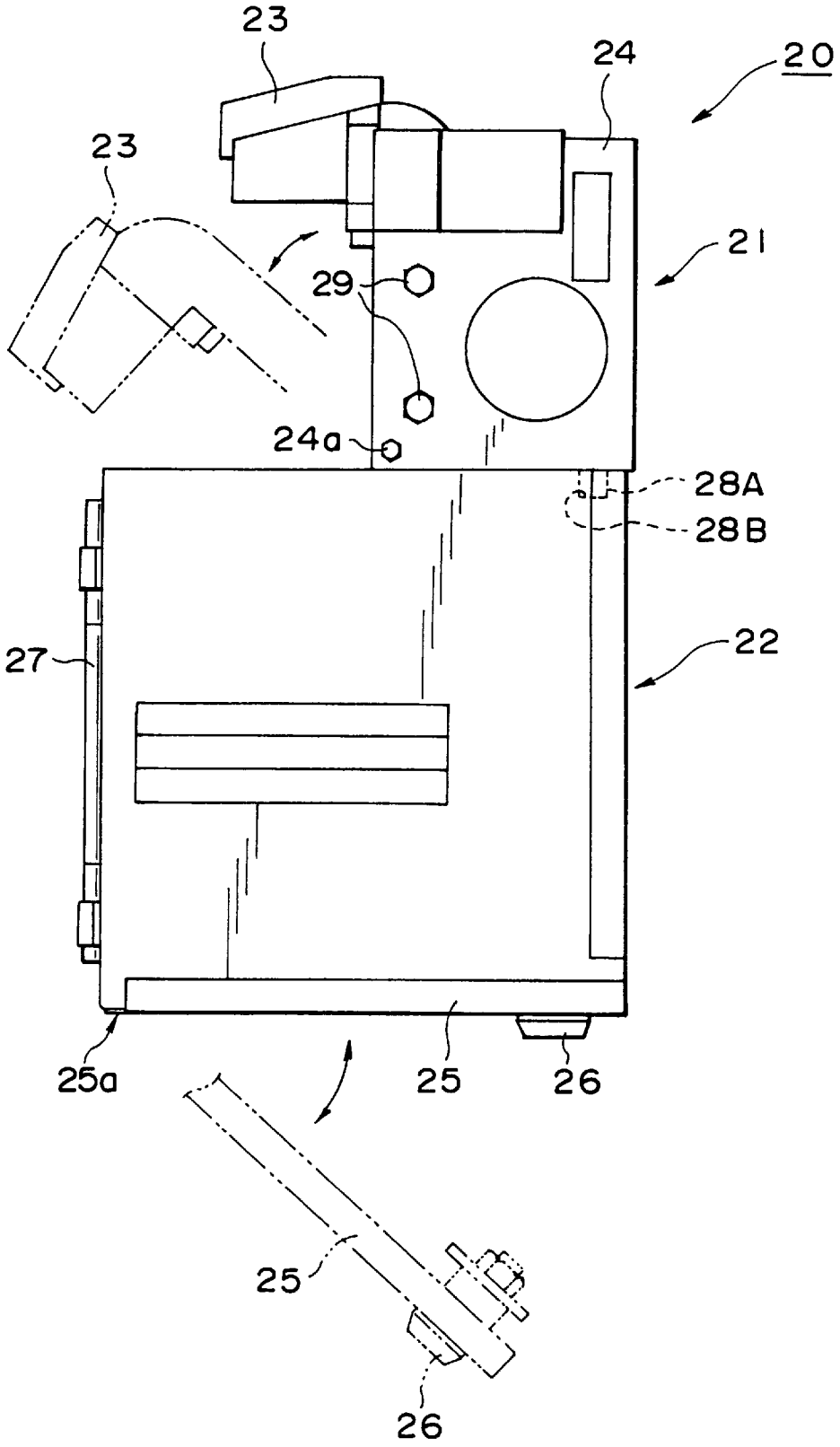
FIG. 3 is a side view of a slit verification unit to be held in the holding apparatus shown in FIG. 1.
Figure 4:
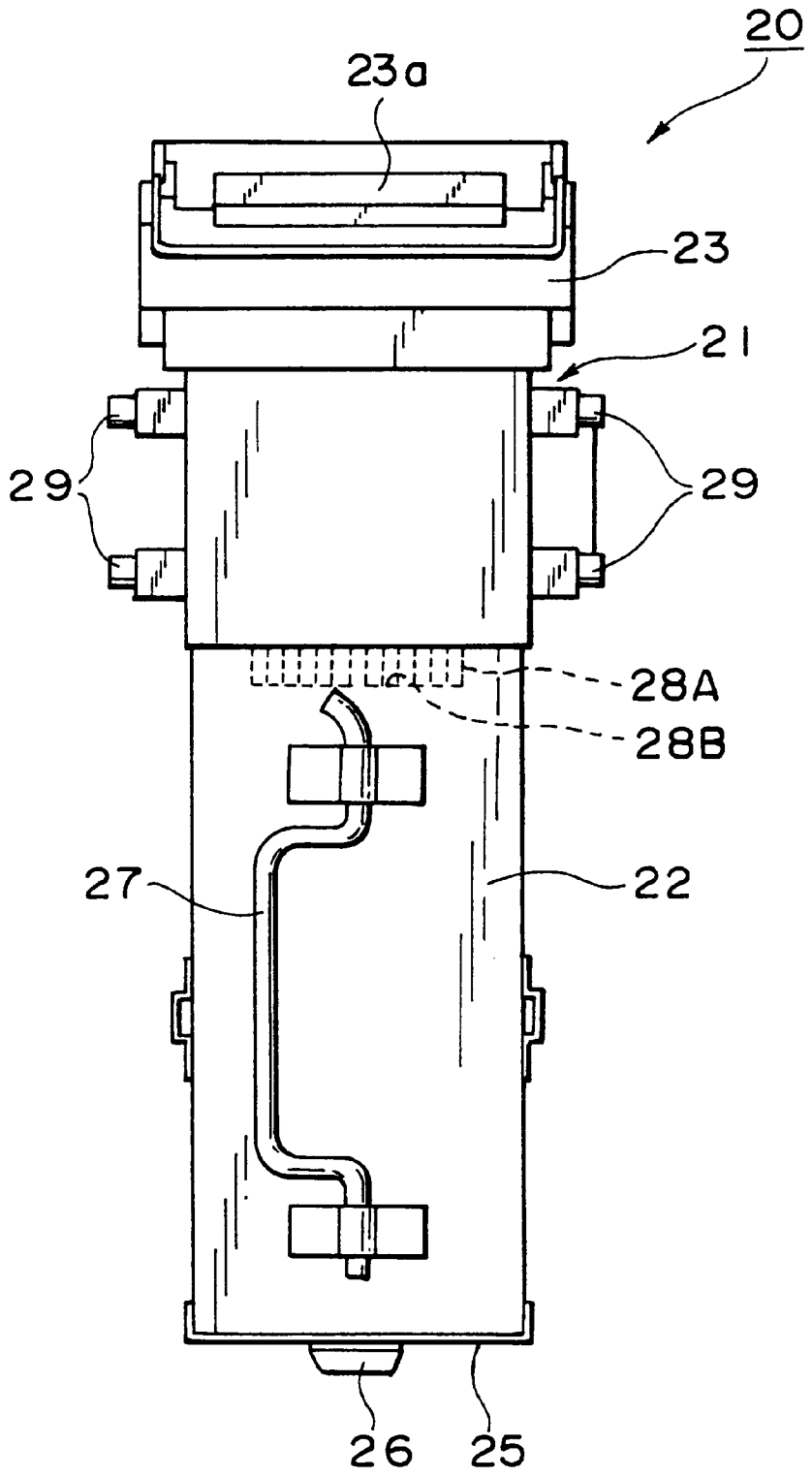
FIG. 4 is a front elevational view of the slip verification unit shown in FIG. 3.

As will be seen also from FIGS. 3 and 4, the slip verification unit 20 has a checkup device 21 and a stacker 22 disposed under the checkup device 21. The checkup device 21 has a movable bezel 23 which has a slip receptacle 23*a* disposed behind the slit 5*a* in the door 5, and a main part 24 which incorporates a sensor (not shown) capable of checking and deciding whether the slip is appropriate, i.e., not a fake.

The bezel 23 is pivotally secured to the main part 24 by means of a pivot shaft 24*a* provided at a lower end portion of the main part 24. When a slip is received by the slip receptacle 23*a*, a slip feeder (not shown) provided in the main part 24 feeds the slip into a slip passage defined between the bezel 23 and the main part 24. The slip is made to pass through this passage so as to be checked up by the sensor in the main part 24. The slip, if judged as being appropriate, is further fed from the checkup device 21 into the stacker 22 in which slips thus accepted are stacked. Slips rejected as being unacceptable are forced back to the slip 5*a* in the door 5, via the slip receptacle 23*a*. As will be understood from an illustration by imaginary lines, the bezel 23 is tiltable about the axis 24*a* so as to open the slip passage, so as to enable access to this passage for the purpose of removal of any jam, cleaning of the passage, and so forth.

The stacker is designed to have a form of a vessel or container capable of storing a stack of a number of slips. The lower end of the stacker 22 is closed by a bottom lid 25, which is hinged to the lower end of the stacker by means of a hinge 25*a*. The space inside the stacker 22 becomes accessible when the bottom lid 25 is swung to an open position, so as to enable slips to be taken out of the stacker 22. The bottom lid 25 is locked by a lock 26, so that any unauthorized person who does not have a key can open the stacker. A handle 27 is secured to the front panel of the stacker 22. Both ends of the handle 17 are rotatably connected to the front panel of the stacker 22.

A pair of connectors 28A, 28B are provided on the lower side of the checkup device 21 and on the upper surface of the stacker 22, so as to mate each other to provide electrical connection between the checkup device 21 and the stacker 22. Connectors 29 are also provided on a side face of the checkup device 21 so as to provide electrical connection between the control circuit of the slot machine 1 and the checkup device 21. When the connectors 28A and 28B are out of engagement with each other, communication between the stacker 22 and the control circuit in the slot machine 1 is interrupted, so that the control circuit performs a predetermined error processing.

As explained before with reference to FIG. 1, the holding apparatus 30 has the stacker-receiving unit 40 and the checkup-device carrier unit 50 provided above the stacker-receiving unit 40. The holding apparatus 30 further has a linking mechanism 70 which links both units 40 and 50. As will be seen also from FIGS. 5 and 6, the stacker-receiving unit 40 has a cage 41 substantially closed at its rear, bottom and both lateral sides so as to receive the stacker 22. The opened front side 41*a* of the cage 41 is adapted to be closed by a door 42. The opened upper side 41*b* of the cage 41 is adapted to be covered by the checkup-device carrier unit 50 and by the checkup device 21 received in the latter.

Figure 5:
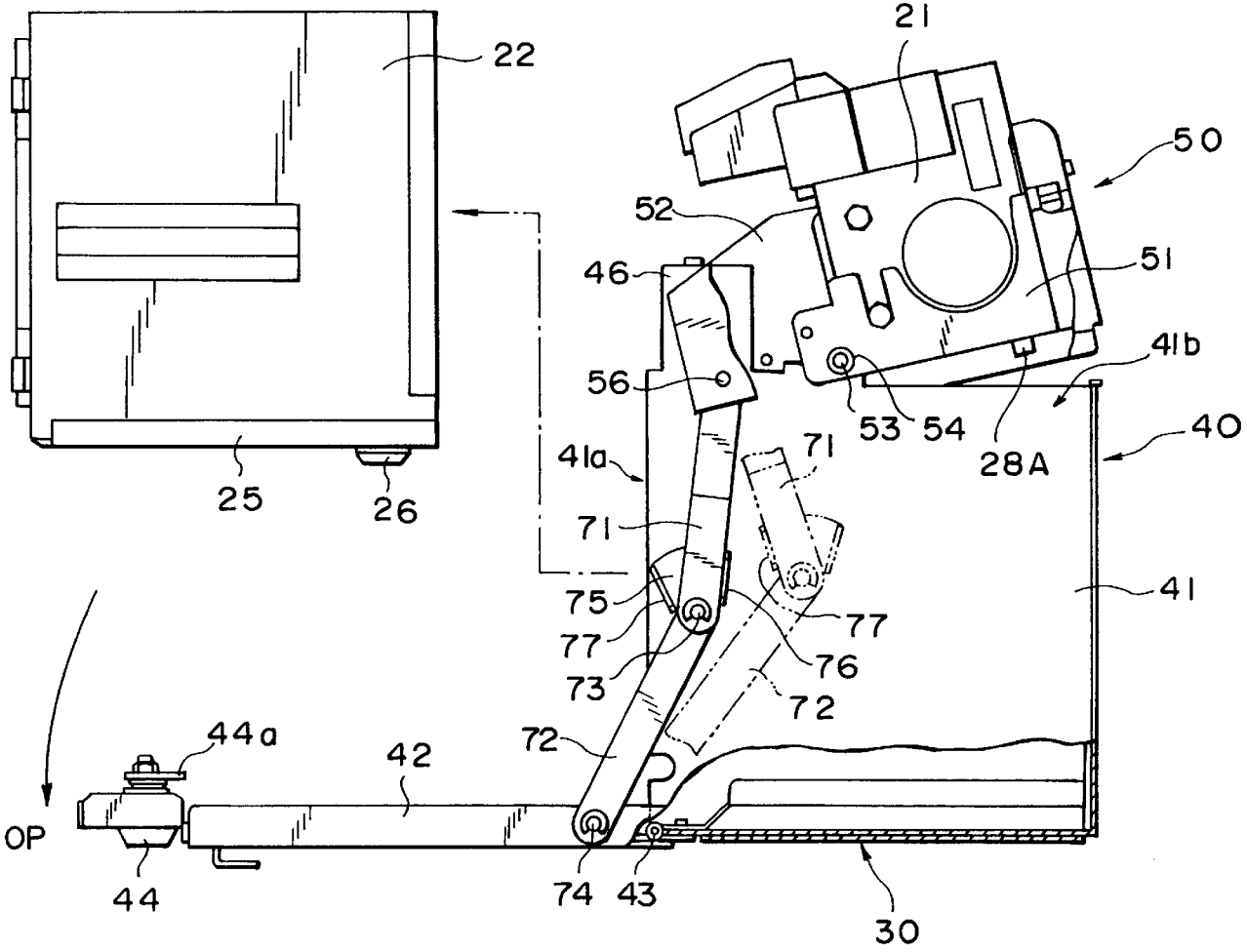
FIG. 5 is a side view of the holding apparatus illustrative of the manner in which a stacker is taken out after opening of a door.
Figure 6B:
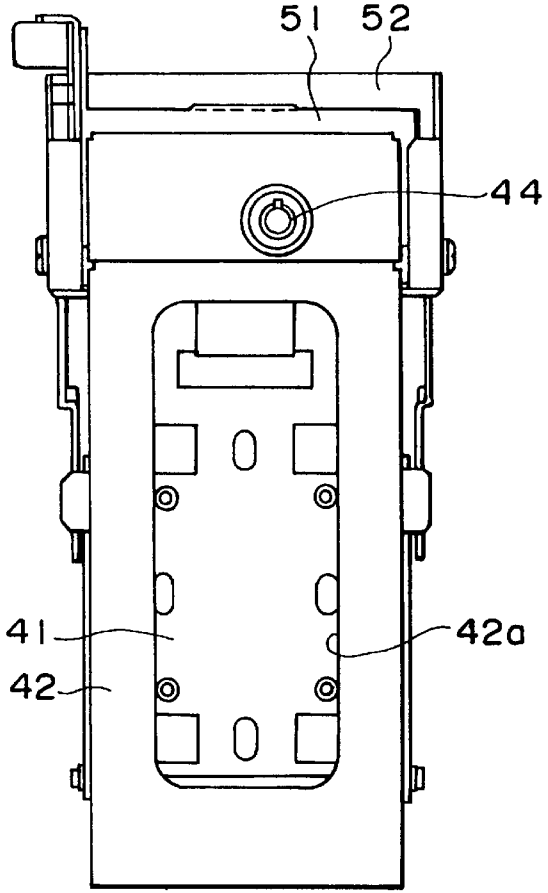
FIGS. 6A and 6B are front elevational views of the holding apparatus shown in FIG. 1.
Figure 6A:
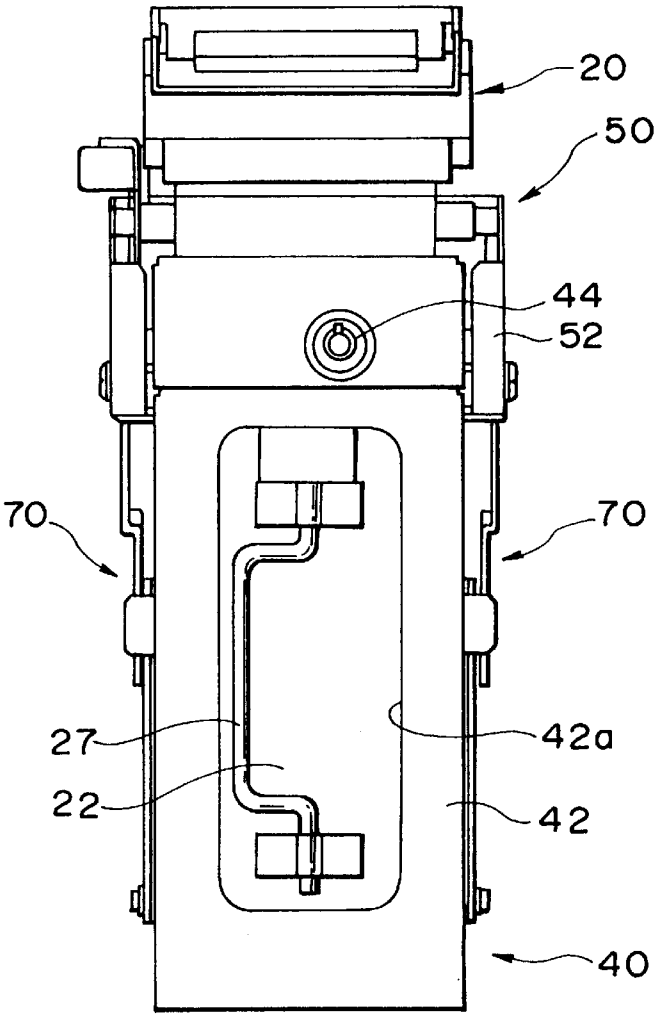

The door 41 is vertically swingable about a horizontal pivot shaft (door shaft) 43 provided at a lower portion of the cage 41, as will be best seen from FIG. 5. The stacker 22 can be pushed and pulled back and forth when the door 42 has been swung to a substantially horizontal open position. A lock 44 is provided on the upper end of the door 42, i.e., the end opposite to the hinge shaft 43. A lock counterpart 45 for cooperating with the lock 44 is formed on the cage 41. The arrangement is such that a rotation of the lock 44 to a locking position after closing of the door 44 brings a latch 44*a* of the lock 44 into engagement with a latch groove 45*a* of the lock counterpart 45, so that the door is locked at the closing position. The lock counterpart 45 is provided therein with a microswitch 46 for detecting whether the door 42 has been closed or opened. As will be seen from FIGS. 5 and 6, a window 42*a* is formed in the door 42 so that one can visually conform through the window 42*a* whether or not the stacker 22 is placed in the stacker-receiving unit 40. FIG. 6A shows a view of the stacker-receiving unit 40 without the stacker housed therein, while FIG. 6B shows a view with the stacker 22 placed inside the stacker-receiving unit 40.

As will be seen from FIGS. 1 and 5, the checkup-device carrier unit 50 has an inner frame 51 which serves as a first holding part for holding the checkup device 21, and an outer frame 52 which serves as a second holding part surrounding the inner frame 51. As shown in detail in FIGS. 7 to 9, a pair of inner frame holding portions 41*a*, 41*a* are formed on upper end portions of both side walls of the cage 41, and a connecting shaft 53 are rotatably held therebetween. The connecting shaft 53 extends through bushes 54, 54 secured to the inner frame 51. Screws 55, 55 are driven into both ends of the connecting shaft 53 externally of the outer frame 52, so that the inner frame 51, outer frame 52 and the cage 41 are connected through a common connecting shaft 53 so as to be able to rotate about the axis of the shaft 53 with respect to one another.

A fixing slider 60 is provided to act between the left side of the inner frame 51 and the outer frame 52. The fixing slider 60 has a pair of elongated holes 60*a*, 60*a* which extend in the back and forth directions of the checkup-device carrier unit. These elongated holes 60*a*, 60*a* slidably receive guide projections 51*a*, 51*a* provided on the inner frame 51. A pawl 60*b* provided on the rear end of the fixing slider 60 is engageable with a retainer groove 52*a* provided in the outer frame 52.

Spring retainers 51*c*, 60*c* are respectively provided on upper end portions of the inner frame 51 and the fixing slider 60, and a tensile coiled spring 62 is stretched between these spring retainers 51*c*, 60*c*. The tensile coiled spring 62 produces force which acts to urge the fixing slider 60 towards the rear end of the inner frame 51 so as to enable the pawl 60*b* to engage with the retaining groove 52*a*. In this state, the inner frame 51 and the outer frame 52 are prevented from rotating relative to each other about the axis of the connecting shaft 53. A finger retainer 60*d* is provided on the fixing slider 60. Pulling of the finger retainer 60*b* forwardly, i.e., rightward as viewed in FIGS. 7 and 8, causes the fixing slider 60 to move forward against the force of the coiled spring 62, this disengaging the pawl 60*b* from the retaining groove 52*a*. In this state, the inner frame 51 can be rotated relative to the outer frame 52 about the axis presented by the connecting shaft 53.

Figure 10B:
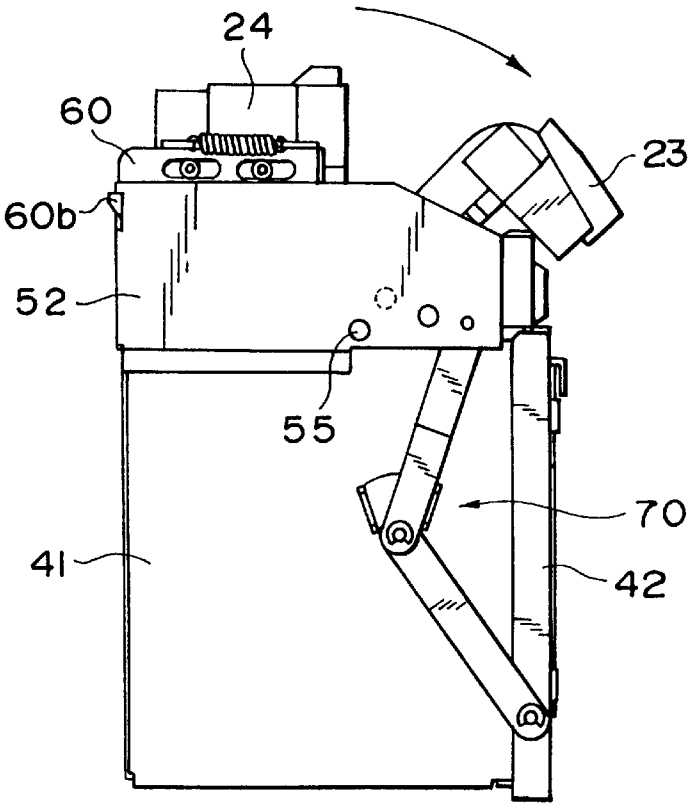
FIG. 10B is an enlarged view of the holding apparatus and the checkup device set in the checkup-device carrier unit, with a bezel of the checkup device tilted to an open position.
Figure 10A:
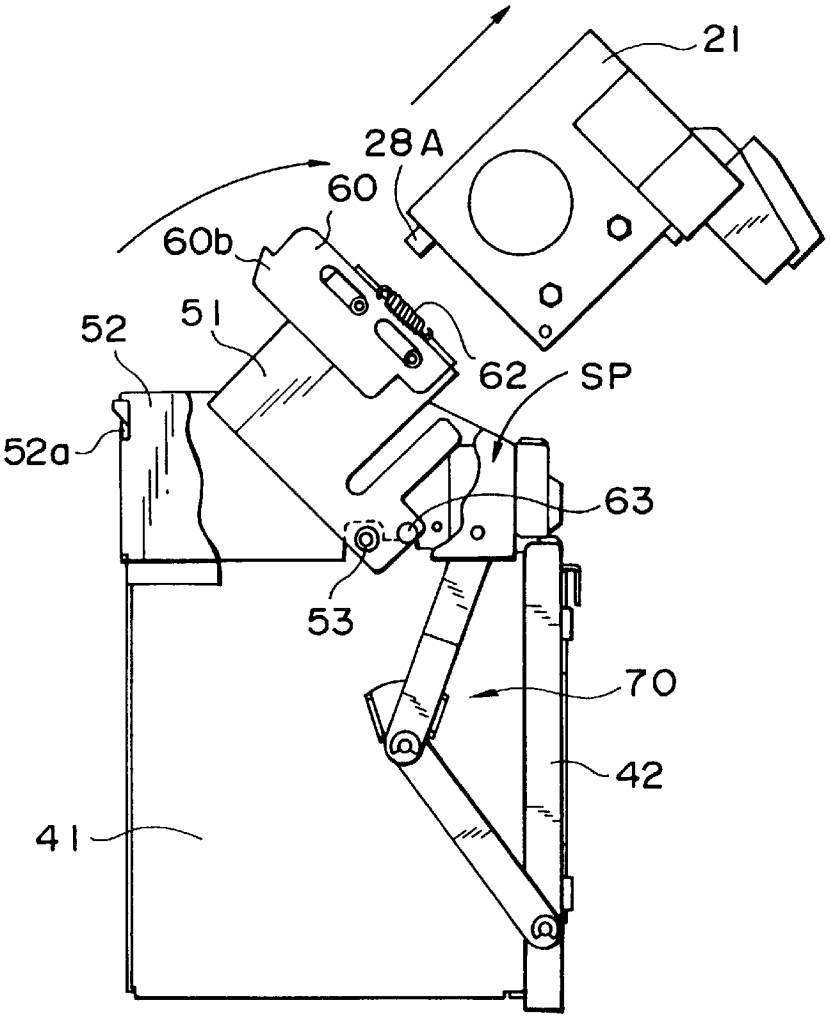
FIG. 10A is an illustration of the relationship between the checkup device and a checkup-device carrier unit of the holding apparatus, showing the manner in which the checkup device is mounted in and demounted from the receiving unit.

Referring now to FIG. 10A, when the inner frame 51 has been swung upward after disengagement of the pawl 60*b* of the fixing slider 60 from the retaining groove 52*a*, the checkup device 21 can be withdrawn obliquely upward in the forward direction from the inner frame 41. A space SP large enough to accommodate the rotation of the inner frame 51 is preserved between the front end of the outer frame 52 and the inner frame 51. As shown in FIG. 10B, the space SP also provides a room which enables the bezel 23 alone of the checkup device 21 to rotate forward with respect to the main part 24. The slip passage along the checkup device 21 then becomes accessible for the purpose of removal of a jamming slip or cleaning of the passage, without interrupting communication between the stacker 22 and the control circuit of the slot machine 1, i.e., without triggering the error processing by the control circuit in the slot machine 1.

A rotation limiter shaft 63 is secured to the inner frame 51 at a position forwardly spaced from the connecting shaft 53. Angle of rotation of the inner frame 51 is limited as the upper end of the cage 41 is stopped by the rotation limiter shaft 63 when the inner frame 51 is rotated upward (see FIG. 7).

Figure 7:
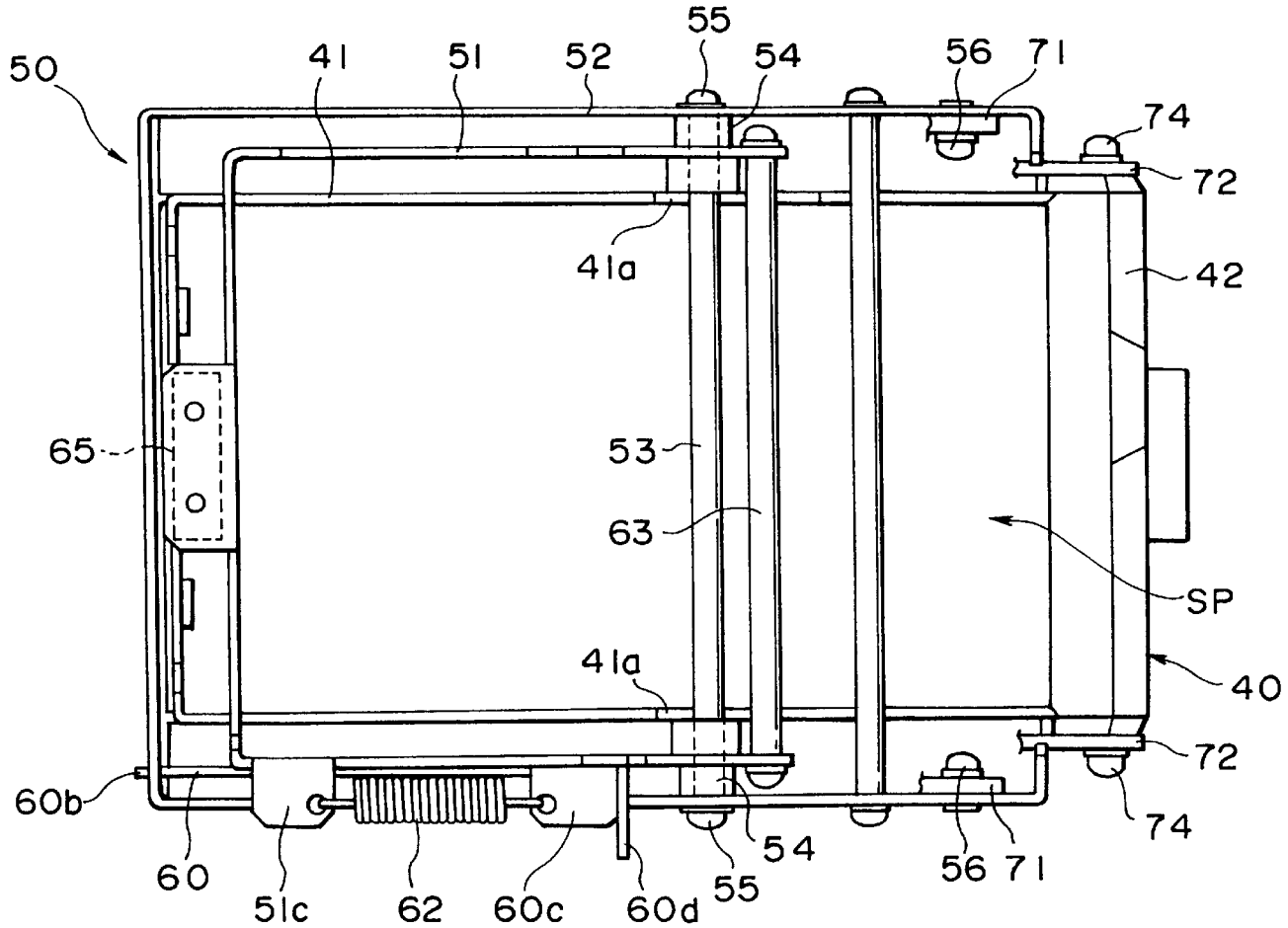
FIG. 7 is a plan view of the holding apparatus shown in FIG. 1.
Figure 9:
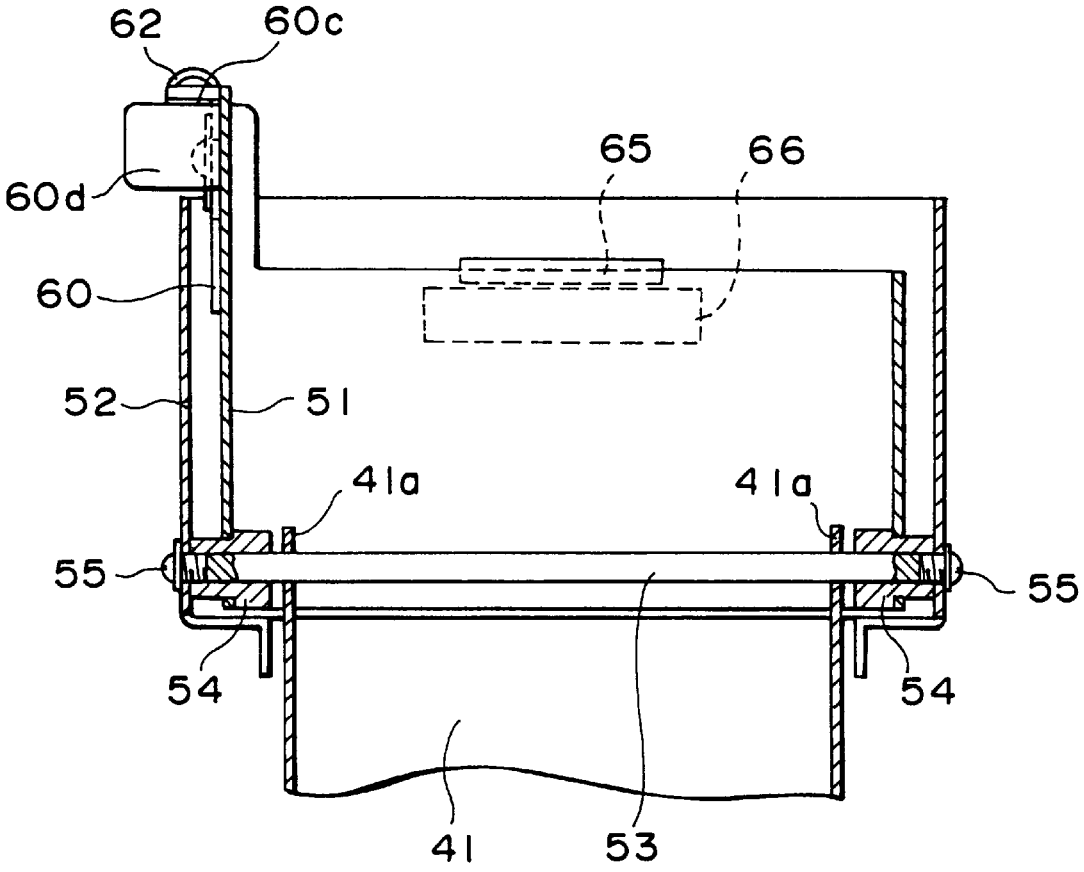
FIG. 9 is a sectional view taken along the line IX—IX of FIG. 8.

As shown in FIGS. 7 and 9, mutually engageable fastening members 65, 66 are provided on the rear ends of the inner frame 51 and the outer frame 52. Counterclockwise rotation of the inner frame 51 about the axis of the connecting shaft 53 from the position shown in FIG. 10A brings the pawl 60*b* of the fixing slider 60 into engagement with the retaining groove 52*a* of the outer frame 52. This in turn causes the fastening members 65, 66 of both frames 51, 52 so as to fasten both frames 51, 52 to each other. Thus, in the described embodiment, the change-over between the state in which the relative rotation between both frames 51, 52 is allowed and the state in which such relative rotation is prohibited requires disengagement and engagement between the pawl 62*b* of the fixing slider 60 and the retaining groove 52*a* in the outer frame 52 and, in addition, disengagement and engagement between the fastening members 65 and 66. Thus, when the inner frame 51 is locked against rotation relative to the other frame 51, both frames are stably held on each other because they are fixed to each other at different portions, as compared with the case where they are fixed at a single position. Various kinds of fastening members are conceivable as the fastening members 65, 66. For instance, one 65 of the fastening members may be a spherical projection while the other 66 is a mating recess for a snap fit. It is also possible to use a magnet as one 65 of the fastening members and a magnetic material as the counterpart 66 of the fastening member. Other types of fastening members are also conceivable.

Figure 8:
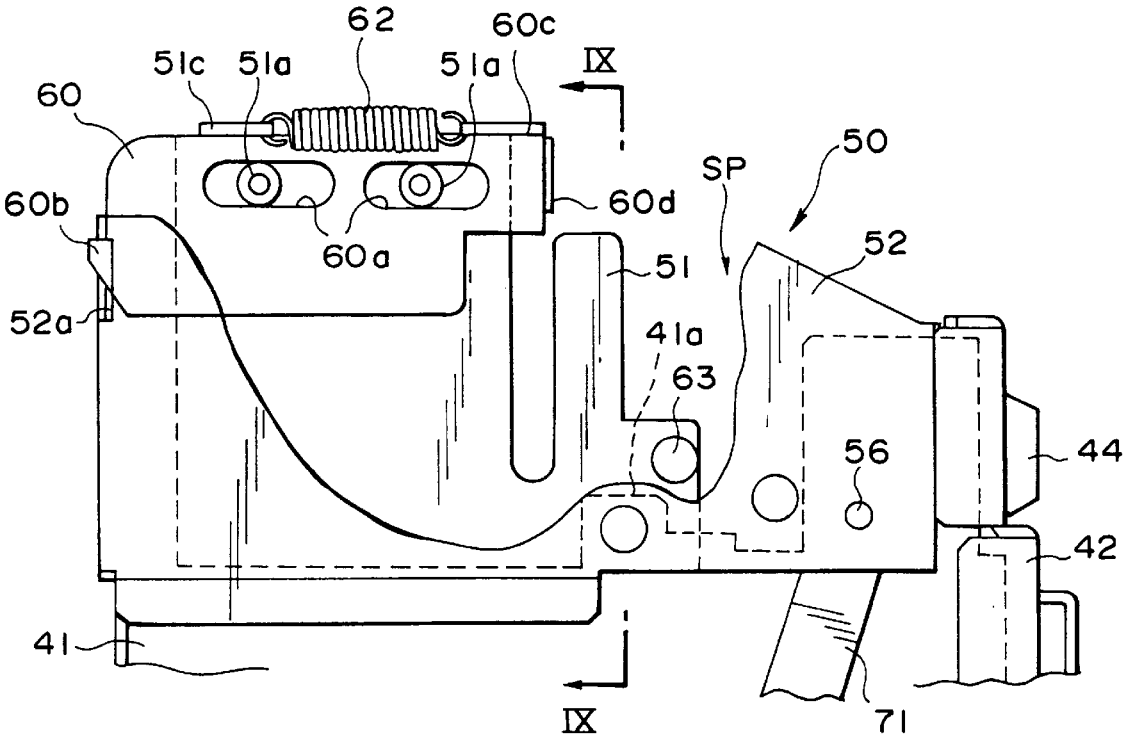
FIG. 8 is an enlarged side view of a checkup device held by the holding apparatus of FIG. 1.

As will be seen from FIGS. 5, 7 and 8, the outer frame 52 is rotatably connected to upper arms 71 of the link mechanism 70, through pins 56, 56 which are provided on the portions of the stacker-receiving unit 40 forwardly spaced from connecting shaft 53, i.e., at the same side of the connecting shaft 63 as the door 42. The upper arms 71 are rotatably connected to lower arms 72 by means of pins 73. The lower arms 72 are pivotally connected to a lower end portion of the door 42 by means of pins 74. Th lower arms 72 have enlarged upper end portions 75 where these arms 72 are connected to the upper arms 71. A pair of rotation limiters 76, 77 are provided on both widthwise ends of each enlarged portion 75. These rotation limiters 76, 77 are adapted to engage with the associated upper arm 71 so as to limit the relative rotation between the upper and lower arms 71, 72 about the pin 73 to a predetermined range of angle.

The operation of this link mechanism 70 is as follows. Opening of the door 42 as indicated by the arrow OP in FIG. 5 causes the pins 56, 56 to move downward as a result of the motion of the link mechanism 70. The downward movement of the pins 56 causes the outer frame 52 to swing counterclockwise as viewed in FIG. 5 about the axis of the connecting shaft 53. Consequently, the rear end of the checkup device 21 is raised to bring its connector 28A out of engagement with the connector 28B of the stacker 22. Therefore, when the door 42 is in the horizontal open position as shown in FIG. 5, the stacker 22 can be pulled forward without being hampered by the connectors 28A, 28B.

Opening of the door 42 to the horizontal open position causes the upper arm 71 to abut the rotation limiter 76 on the associated lower arm 72. In this state, the upper arm 71 is prevented from rotating clockwise in FIG. 5 about the pin 73, this eliminating any risk of clockwise rotation of the inner and outer frames 51, 52 about the axis of the connecting shaft 53, which rotation otherwise would occur due to the weights of the checkup device 21 and the checkup-device carrier unit 50. Consequently, the connectors 28A, 28B are kept away from each other without fail.

When the door 42 is closed after the stacker 22 is received in the cage 41, the checkup device 21 resumes the position shown in FIGS. 10A and 10B, while bringing its connector 28A again into engagement with the mating connector 28B of the stacker 22. In a predetermined angular range of rotation of the door 42, e.g., a range of several degrees immediately preceding to full shutting of the door 42, the rotation limiter 77 of the lower arm 72 abuts the associated upper arm 71 as shown by imaginary lines in FIG. 5, thus preventing the upper arm 71 from further rotating counter-clockwise as viewed in FIG. 5 about the pin 73. Therefore, immediately before the door 42 is moved into the full shut position, the lower arm 72 rotates clockwise as viewed in FIG. 5 in accordance with the movement of the door 42, so as to displace the associated pin 73 obliquely downward. The displacement of the pin 73 is transmitted to the checkup-device carrier unit 50 via the upper arm 71, so that downward force is generated to act on the checkup device 21 in the checkup-device carrier unit 50, whereby the connector 28A is brought into firm engagement with the mating connector 28B.

In order that the downward force is transmitted to the checkup device 21 via the checkup-device carrier unit 50, it is necessary that the pawl 62*b* of the fixing slider 60 is in engagement with the retaining groove 52*a* in the outer frame 52 so as to lock both frames 51, 52 against rotation relative to each other, and that the checkup device 21 is constrained in the inner frame 51 by a downward force so that the checkup device 21 does not move upward apart from the inner frame 51. To this end, it is preferred that the fixing slider 60 is provided with a member which can be brought into engagement with the checkup device 21 from the upper side thereof when the pawl 62*b* of the fixing slider 60 is brought into engagement with the retaining groove 52*a* of the outer frame 52, thus enabling the fixing slider 60 to retain the checkup device 21.

FIGS. 11 to 14 illustrate the relationship between the holding apparatus 30 heretofore described and the mounting base 10 through which the holding apparatus 30 is fixed to the machine housing 2. As shown particularly in FIGS. 11 and 12, the mounting base 10 and the holding apparatus 30 are connected to each other through a position adjusting mechanism 80. The mounting base 10 is fixed to a frame (not shown) in the housing by, for example, welding.

The position adjusting mechanism 80 is intended to keep the slip receptacle 23*a* of the slip verification unit 20 held by the holding apparatus 30 in alignment with the slit 5*a* (see FIG. 2) provided in the door 5 of the housing 2. The position adjusting mechanism 80 includes a bracket 81 adapted to be held in close contact with a front panel 10*a* of the mounting base 10, a spacer 83 closely fixed to a front panel 81*a* of the bracket 81 by means of screws 82, and a latch plate 85 secured by screws 84 to a support plate 10*c* projecting from a top panel 10*b* of the mounting base 10. The screws 84 are screwed into nuts 10*d* on the support plate 10 through vertically elongated holes 85*a* 8see FIG. 13) formed in the latch plate 85, Thus, the latch plate 85 is adjustable in the up and down directions.

The latch plate 85 has a horizontal web 85*b* to which are welded buts 86. Height adjustment screws 87 with hexagonal heads are driven into the nuts 86 such that the lower ends of the screws 87 project downward from the horizontal web 85*b* so as to abut the top panel 10*b* of the mounting base 10. A spacer 88 is interposed between the horizontal web 85*b* and the top panel 10*b*. As will be clearly understood from FIG. 13, the bracket 81 is provided with a pair of engaging parts 81*b*, 81*b* for engagement with the top panel 10*b* of the mounting base 10. The spacer 88 and the latch plate 85 are positioned between the engaging parts 81*b*, 81*b* so as not to interfere therewith.

A hook 85*c* provided on the free end of the horizontal web 85*b* of the latch plate 85 is adapted to be inserted into the cage 41 through a window 41*c* formed in a rear portion of the case 41 of the holding apparatus 30 (see FIG. 14). There are four nuts 11 and four nuts 89 welded to the inner face of the mounting base 10 and to the inner face of the bracket 81. Four screws 90 are driven into the nuts 11 from the interior of the cage 41, so that the bracket 81 and the mounting base 10 are fixed to each other. Similarly, four screws 91 are driven into the nuts 89 from the interior of the cage 41 so that the cage 41 and the bracket 81 are fixed to each other. It is to be noted that, since all these screws 11 and 89 are driven from the interior of the cage 41, it is impossible to remove the cage 41 from the housing 2, unless the stacker is withdrawn from the cage 41. Withdrawal of the stacker 22 from the cage 41 essentially requires that the door 42 be opened by unlocking the lock 44. It is therefore very difficult take the holder apparatus 30 and the stacker 22 as a unit out of the housing 2, whereby a remarkable antitheft effect can be achieved.

Figure 13:
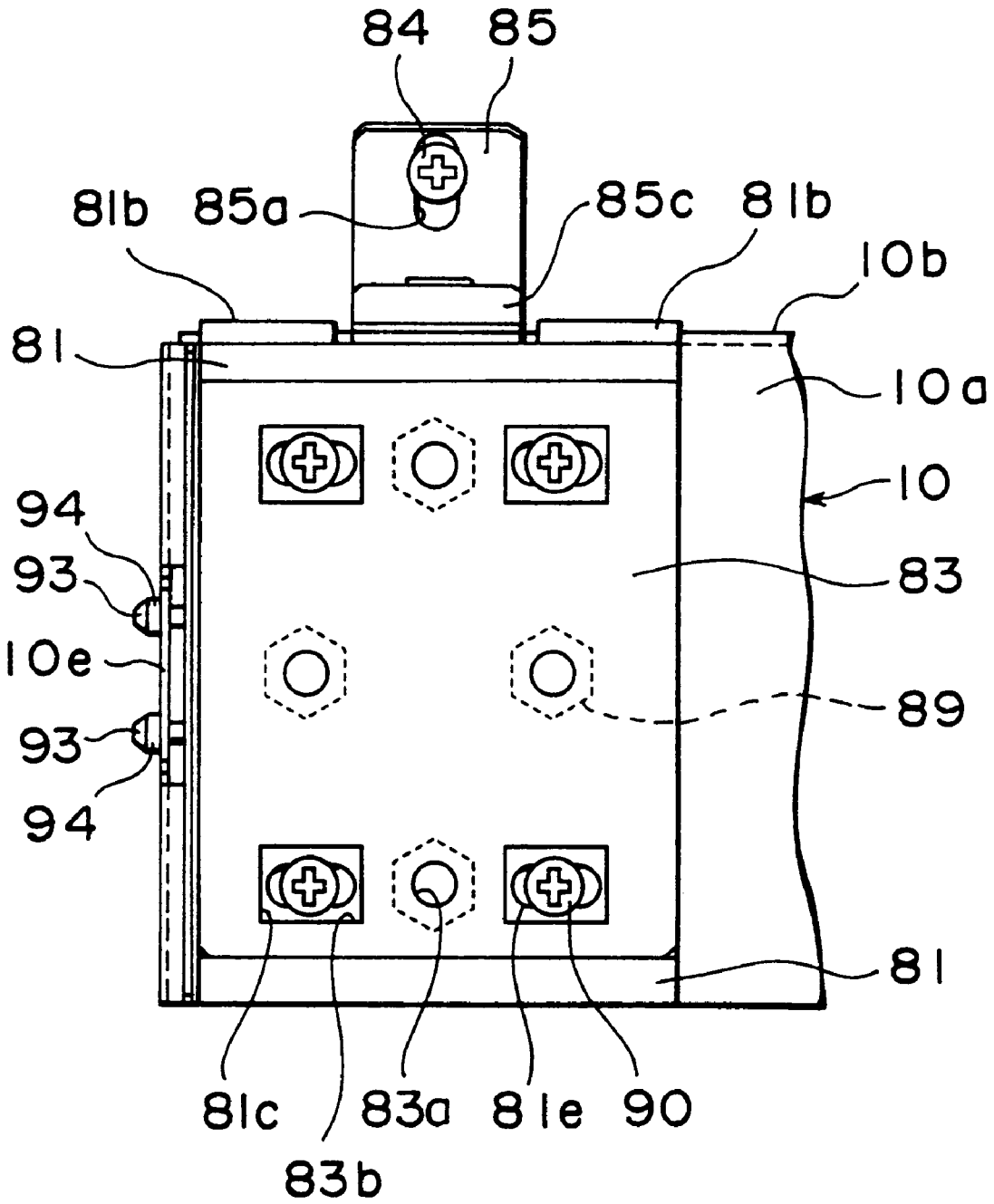
FIG. 13 is an illustration of the mechanism of FIG. 11, as viewed in the direction of the arrow XIII of FIG. 12.

Referring now to FIG. 14, four vertically elongated holes 41*d* for receiving screws 91, as well as four square through holes 41*e* for receiving the screws 90, are formed in the rear side of the cage 41. As shown in FIG. 13, the spacer 83 is provided with four through holes 83*a* corresponding to the nuts 89 welded to the bracket 81 and four square through holes 83*b* for receiving the screws 90. Through holes 81*c* similar to the through holes 83*b* are formed in the front panel 8 la of the bracket 81. Four horizontally elongated holes 81*c* for receiving the screws 81 are formed in the rear panel 81*d* of the bracket 81.

As shown in FIGS. 11 and 14, four adjusting screws 92 for adjusting the position in back and forth directions, which are hexagon-hole bolts, are screwed into the rear side of the cage 41, such that the ends of these screws 92 abut the spacer 83. Referring also to FIGS. 13 and 14, a tab 10*c* is formed on the left side surface of the mounting base 10, and adjusting screws 93, 93 for adjusting the position in the left and right directions are screwed into the tab 10*e*, such that the ends of these screws 93, 93 abut the left side surface of the bracket 80. A spacer 94 is interposed between each screw 93 and the tab 10*e*.

The position adjusting mechanism 80 having the described construction is capable of adjusting the position of the holding apparatus 30 up and down, to the left and right and back and forth. More specifically, the position of the cage 41 is adjustable in height-wise direction by causing the latch plate 85 to move up and down by means of the screws 87, after loosening the screws 84 and 91. The position of the cage 41 is adjustable also in the left and right directions, by changing the amount of driving of the screws 93 into the tab 10*e* after loosening the screws 90, while causing the bracket 81 to abut these screws 93. The adjustment of the position of the cage 41 in the back and forth directions can be effected by varying the amount of projection of the screws 92 from the cage 41 after loosening the screws 91, and causing the screws 92 to abut the spacer 83. Ranges of position adjustment in all these three directions can be varied by removing the spacers 83*m* 88 and 94 or by employing greater numbers of spacers.

The embodiments heretofore described are not exclusive and various changes and modifications may be imparted thereto. For instance, although a double structure having the inner frame 51 and the outer frame 52 has been specifically mentioned, this is only illustrative and the arrangement may be such that the checkup device 21 is directly fixed to the outer frame 52. The arrangement also may be such that the checkup-device carrier unit 50 is linearly moved relative to the stacker-receiving unit 40 in response to the motion of the door 42, so as to bring the connector 28A into and out of engagement with the mating connector 28B. It is also to be understood that the described invention can be used as the holding apparatus in a variety of types of game machines, although a slot machine has been specifically mentioned.

As will be understood from the foregoing description, the present invention offers the following advantages over known arts. When the door of the holding apparatus installed in the game machine is opened for the purpose of removal of the stacker from the game machine, the checkup device which is smaller in weight rather than the stacker which is greater in weight is moved in response to the motion of the door so as to disengage the connectors between the checkup device and the stacker from each other, thereby enabling withdrawal of the stacker. Since the checkup device does not have substantial weight, the linking mechanism, which drivingly connects the door to the member carrying the checkup device, can be actuated with a smaller power and, hence, need not have high rigidity and strength than in the case where the heavy stacker is moved in response to the door motion. Consequently, the holding apparatus can have smaller size and weight, which significantly reduce the man-hour required for the fabrication of the holding apparatus, thus contributing to reduction in the costs of production.

What is claimed is:

1. A holding apparatus for holding a slip verification unit which is incorporated in the housing of a game machine and which includes a checkup device for checking slips and a stacker disposed under the checkup device and capable of accommodating a stack of the slips accepted by said checkup device, said checkup device and said stacker being connected through a pair of mating connectors, said holding apparatus comprising:

a stacker-receiving unit for receiving said stacker therein, having a front door closing the front side and movable to an open position to open the front side thereof;

a checkup-device carrier unit capable of carrying said checkup device and movable relative to said stacker-receiving unit in such directions as to bring said mating connectors into and out of engagement with each other; and an interconnecting mechanism for operatively interconnecting said door and said checkup-device carrier unit such that said checkup-device carrier unit moves to disengage said mating connectors when said door is opened.

2. A holding apparatus according to claim 1, wherein said checkup-device carrier unit has a first holding part for holding said checkup device and a second holding part connected to said first holding part for relative movement therebetween in a predetermined direction, said checkup device being detachable from said checkup-device carrier unit by a movement of said first holding part relative to said second holding part while said second holding part is held at a predetermined position relative to said stacker-receiving unit.

3. A holding apparatus according to claim 1, wherein said checkup device has a movable part operable to open a passage of said slips, and wherein said checkup-device carrier unit has a space which accommodates the movement of said movable part of said checkup device while said checkup device is carried by said checkup-device carrier unit.

4. A holding apparatus according to claim 1, wherein said checkup-device carrier unit and said stacker-receiving unit are rotatably connected to each other through a horizontal connecting shaft disposed on said stacker-receiving unit at a position which is on the same side of said connectors as the front end of said stacker-receiving unit, wherein said door is swingably carried by a horizontal door shaft provided on a lower portion of said stacker-receiving unit for movement between open and close positions about an axis provided by said door shaft, and wherein said interconnecting mechanism includes a link mechanism which interconnects said door and a pivot point provided on said checkup-device carrier unit at a position which is on the same side of said connecting shaft as the front end of said stacker-receiving unit.

5. A holding apparatus according to claim 4, wherein said link mechanism includes link elements and means for limiting the movement of said link elements such that a force for bringing said connectors into engagement is generated in response to the closing motion of said door immediately before reaching the full shut position.

6. A holding apparatus according to claim 4, wherein said checkup-device carrier unit includes:

a first holding frame for receiving said checkup device;

a second holding frame surrounding said first holding frame and rotatably connected to said first holding frame through a horizontal shaft, said second holding frame having said pivot point thereon; and change-over means for effecting change-over between a state which permits relative rotation between said first and second holding frames and a state which prohibits such a relative rotation.

7. A holding apparatus according to claim 6, wherein said change-over means includes at least a pair of mutually cooperating engaging portions.

8. A holding apparatus according to claim 7, wherein said at least a pair of mutually cooperating engaging portions include a movable member associated with said first holding frame and a retaining groove provided in said second holding frame and capable of receiving part of said movable member.

9. A holding apparatus according to claim 7, wherein said at least a pair of mutually cooperating engaging portions include a magnet provided on one of said first and second holding frames and a magnetic member provided on the other of said first and second holding frames.

10. A holding apparatus according to claim 8, wherein said movable member is engageable with said checkup device from the upper side of said checkup device.

11. A game machine, comprising:

a main body having a housing;

a slip verification unit including a checkup device for checking slips and a stacker disposed under said checkup device and connected thereto through a pair of mating connectors, said stacker receiving slips which have been accepted through said checkup device;

a holding apparatus for holding said slip verification unit; and a structure for fixing said holding apparatus to said housing;

wherein said holding apparatus comprises:

a stacker-receiving unit for receiving said stacker therein, having a front door closing the front side and movable to an open position to open the front side thereof;

a checkup-device carrier unit capable of carrying said checkup device and movable relative to said stacker-receiving unit in such directions as to bring said mating connectors into and out of engagement with each other; and an interconnecting mechanism for operatively interconnecting said door and said checkup-device carrier unit such that said checkup-device carrier unit moves to disengage said mating connectors when said door is opened.

12. A game machine according to claim 11, wherein said checkup-device carrier unit has a first holding part for holding said checkup device and a second holding part connected to said first holding part for relative movement therebetween in a predetermined direction, said checkup device being detachable from said checkup-device carrier unit by a movement of said first holding part relative to said second holding part while said second holding part is held at a predetermined position relative to said stacker-receiving unit.

13. A game machine according to claim 11, wherein said checkup device has a movable part operable to open a passage of said slips, and wherein said checkup-device carrier unit has a space which accommodates the movement of said movable part of said checkup device while said checkup device is carried by said checkup-device carrier unit.

14. A game machine according to claim 11, wherein said checkup-device carrier unit and said stacker-receiving unit are rotatably connected to each other through a horizontal shaft disposed on said stacker-receiving unit at a position which is on the same side of said connectors as the front end of said stacker-receiving unit, wherein said door is swingably carried by a horizontal door shaft provided on a lower portion of said stacker-receiving unit for movement between open and close positions about an axis provided by said door shaft, and wherein said interconnecting mechanism includes a link mechanism which interconnects said door and a pivot point provided on said checkup-device carrier unit at a position which is on the same side of said connecting shaft as the front end of said stacker-receiving unit.

15. A game machine according to claim 14, wherein said link mechanism includes link elements and means for limiting the movement of said link elements such that a force for bringing said connectors into engagement is generated in response to the closing motion of said door immediately before reaching the full shut position.

16. A game machine according to claim 14, wherein said checkup-device carrier unit includes:

a first holding frame for receiving said checkup device;

a second holding frame surrounding said first holding frame and rotatably connected to said first holding frame through a horizontal shaft, said second holding frame having said pivot point thereon; and change-over means for effecting change-over between a state which permits relative rotation between said first and second holding frames and a state which prohibits such a relative rotation.

17. A game machine according to claim 11, wherein said structure for fixing said holding apparatus to said housing is adjustable to vary the position of said holding apparatus with respect to said housing at least in one of the vertical direction, left and right direction and back and forth direction.

18. A game machine according to claim 11, wherein said structure for fixing said holding apparatus to said housing is accessible for the removal of said holding apparatus from said housing only from the interior of said stacker-receiving unit.

* * * * *